US012358715B2

(12) United States Patent
Melancon

(10) Patent No.: US 12,358,715 B2
(45) Date of Patent: Jul. 15, 2025

(54) CONTAINER WITH RAMPWALL

(71) Applicant: Melancon Holdings LLC, Lynchburg, VA (US)

(72) Inventor: Dennis Wayne Melancon, Lynchburg, VA (US)

(73) Assignee: Melancon Holdings, LLC, Lynchburg, VA (US)

( * ) Notice: Subject to any disclaimer, the term of this patent is extended or adjusted under 35 U.S.C. 154(b) by 0 days.

(21) Appl. No.: 18/474,716

(22) Filed: Sep. 26, 2023

(65) Prior Publication Data

US 2024/0417162 A1 Dec. 19, 2024

Related U.S. Application Data

(63) Continuation of application No. 18/333,611, filed on Jun. 13, 2023, now abandoned.

(51) Int. Cl.
*B65D 88/54* (2006.01)
*B65D 88/10* (2006.01)

(52) U.S. Cl.
CPC ..... *B65D 88/542* (2013.01); *B65D 88/10* (2013.01)

(58) Field of Classification Search
CPC ..... B65D 88/542; B65D 88/10; B65D 88/58; B65D 88/127; B65D 88/121; B65D 88/12
USPC ..... 220/1.5; 410/6
See application file for complete search history.

(56) References Cited

U.S. PATENT DOCUMENTS 1,740,000 A * 12/1929 Andrews ..... B65D 90/0086 105/377.05
2,621,070 A * 12/1952 Crivella ..... B60P 3/04 119/512
4,854,460 A * 8/1989 Josephs ..... B65D 88/121 220/1.5
10,252,855 B1 * 4/2019 Melancon, Jr. ..... B65D 88/542
11,485,573 B1 * 11/2022 Melancon, Jr. ..... B65D 88/542
2006/0028048 A1 * 2/2006 Brenneman ..... B60J 5/108 296/146.8
2009/0064428 A1 * 3/2009 Hoffman ..... B65D 88/542 14/71.1
2017/0341559 A1 * 11/2017 Melancon, Jr. ..... B65D 88/123
2020/0377293 A1 * 12/2020 Morgan ..... B65D 90/0033

FOREIGN PATENT DOCUMENTS

CN 107758155 A * 3/2018 ..... B65D 90/00
WO WO-2016024934 A1 * 2/2016 ..... B65D 88/126

* cited by examiner

*Primary Examiner* — Rafael A Ortiz

(74) *Attorney, Agent, or Firm* — LAUBSCHER & FRETWELL, P.C.

(57) ABSTRACT

A container for storing and transporting materials includes a container body having a generally rectangular configuration with bottom and side walls and a front and rear end defining an inner chamber. A generally rectangular ramp wall is pivotably connected with the container body adjacent the front end. The ramp wall pivots about at least one of a horizontal and vertical axis to provide pivotal movement of the ramp wall between closed and open positions, respectively. The ramp wall further has a height that is less than, equal to or greater than a height of at least one of the side walls and a width which is generally equal to a width of the container body. Preferably, the container further comprises at least one front end door that is pivotably connected with the container body to provide access to the inner chamber via the front end.

7 Claims, 10 Drawing Sheets

CONTAINER WITH RAMPWALL

BACKGROUND OF THE INVENTION

The present invention relates to a container for storage and transportation of materials, and more particularly to such a container having a ramp wall.

Containers having ramp walls are known in the art. The Melancon U.S. Pat. Nos. 9,067,524 and 9,545,867 disclose a ramp wall for a container wherein the ramp wall includes a motor for pivoting the ramp wall between its open and closed position. The Melancon U.S. Pat. No. 9,884,575 includes a ramp wall that has a lower end pivot assembly which includes a pair of torsion springs which provide for manual movement of the ramp wall by an individual. The Melancon U.S. Pat. No. 10,252,855 further discloses a ramp wall which is configured to pivot about horizontal and vertical axes to allow for a wall which can pivot downward and thus function as a ramp and, alternatively, swing open and function as a door. The entire contents of the '524, '867, '575 and '855 patents are incorporated herein by reference.

Though the containers with ramp walls of these patents and of other known containers in the art provide containers which can both secure contents within the container and allow for heavy trucks and machinery to drive into the container, there are drawbacks in the ease of access to the inner chambers of these containers as well as to sufficiently securing the inner chamber and any contents therein.

There is thus a need for a container having a ramp with an alternate configuration from those known in the art to provide for both securement of materials and a ramp which allows heavy machinery to enter the container, but also provide for ease of access to and protection of the inner chamber of a container.

SUMMARY OF THE INVENTION

Accordingly, and object of the present disclosure is to provide a container for storing and transporting materials which includes a container body having a generally rectangular configuration with bottom and side walls and a front and rear end defining an inner chamber. A generally rectangular ramp wall is pivotably connected with the container body adjacent the front end. The ramp wall pivots about at least one of a horizontal and vertical axis to provide pivotal movement of the ramp wall between closed and open positions, respectively. The ramp wall further has a height that is less than a height of at least one of the side walls and a width which is generally equal to a width of the container body. Preferably, the container further comprises at least one front end door that is pivotably connected with the container body to provide access to the inner chamber via the front end.

In one embodiment, the height of the ramp wall when it is in its closed position is greater than half the height of at least one of the container side walls.

In another embodiment, two front end doors are pivotably connected with the container body and are arranged above the ramp wall when the ramp wall is in its closed position. Preferably, the two front end doors are pivotably connected with respective side walls of the container body to provide swinging movement of the two front end doors between closed and open positions.

In yet another embodiment, the container includes a top wall connected with the rear and side walls. The top wall preferably includes a rigid structure that is either flat or pitched having a length and width that is generally equal to a length and width of the container.

In a further embodiment, the container further includes at least one pivot shaft and at least one helical torsion spring to provide pivotal movement of the ramp wall relative to the container body. The at least one pivot shaft is arranged at a lower end of the container front end and connected with a lower end of the ramp wall. The at least one helical torsion spring is arranged around the at least one pivot shaft.

BRIEF DESCRIPTION OF THE DRAWINGS

The invention will be explained in greater detail below using embodiments with the aid of the accompanying figures in which.

DETAILED DESCRIPTION

Figure 1:
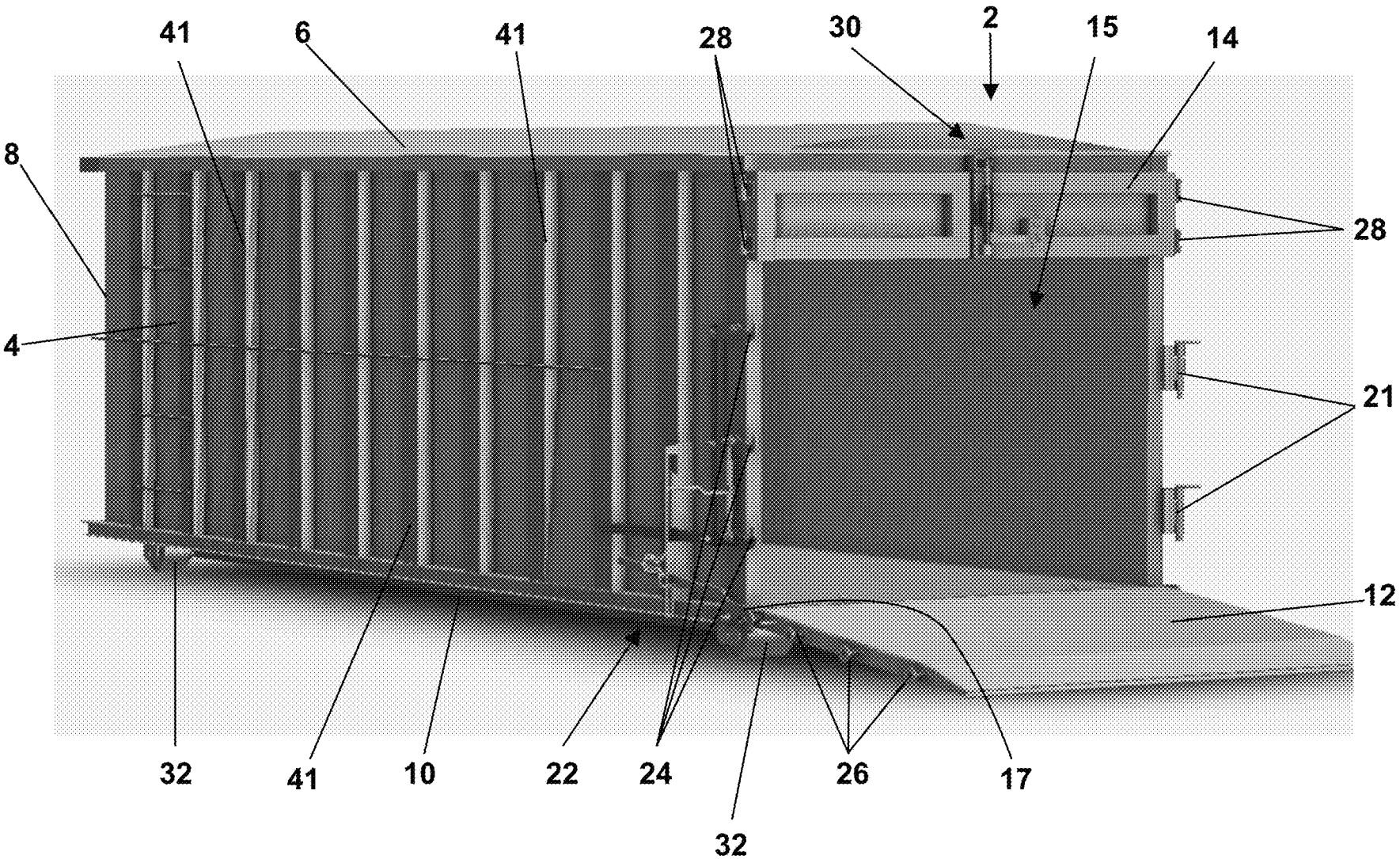
FIG. 1 is a perspective view of a container having a ramp wall according to the present disclosure.

In the following description of the figures, front, rear and similar terms are used to refer to ends of containers. These terms should not be understood to be restrictive, and it will be understood by those with skill in the art that these terms can be interchanged without deviating from the spirit and scope of the disclosure.

Referring first to FIGS. 1-7, a first embodiment of a container having a ramp wall according to the present disclosure is shown. The container 2 includes a container body having side walls 4, a top wall 6, a rear wall 8, a bottom wall 10, a front ramp wall 12, a pair of front barn door style walls 14, and a container inner chamber 15.

Figure 3:
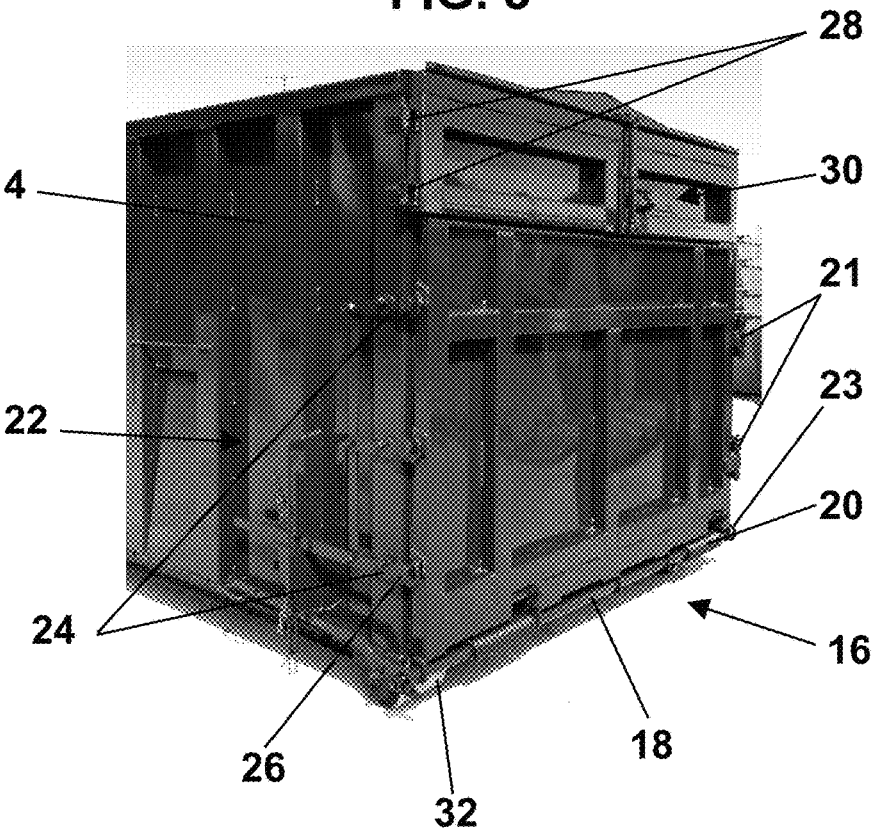
FIG. 3 is a front perspective view of the container of FIG. 1.
Figure 4:
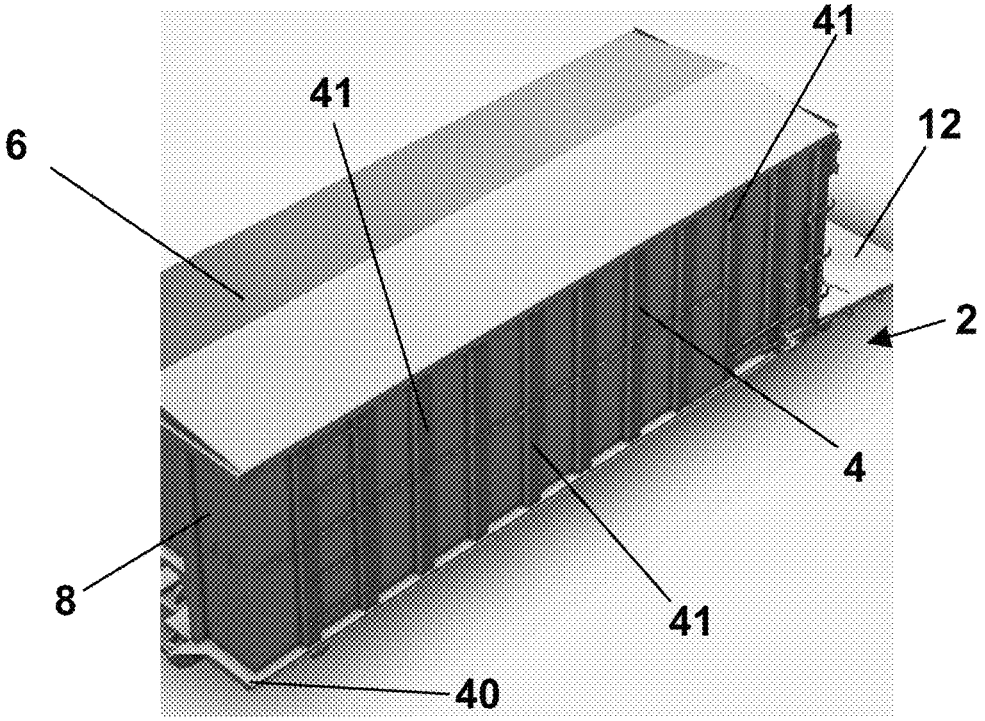
FIG. 4 is a top perspective view of the container of FIG. 1.
Figure 5:
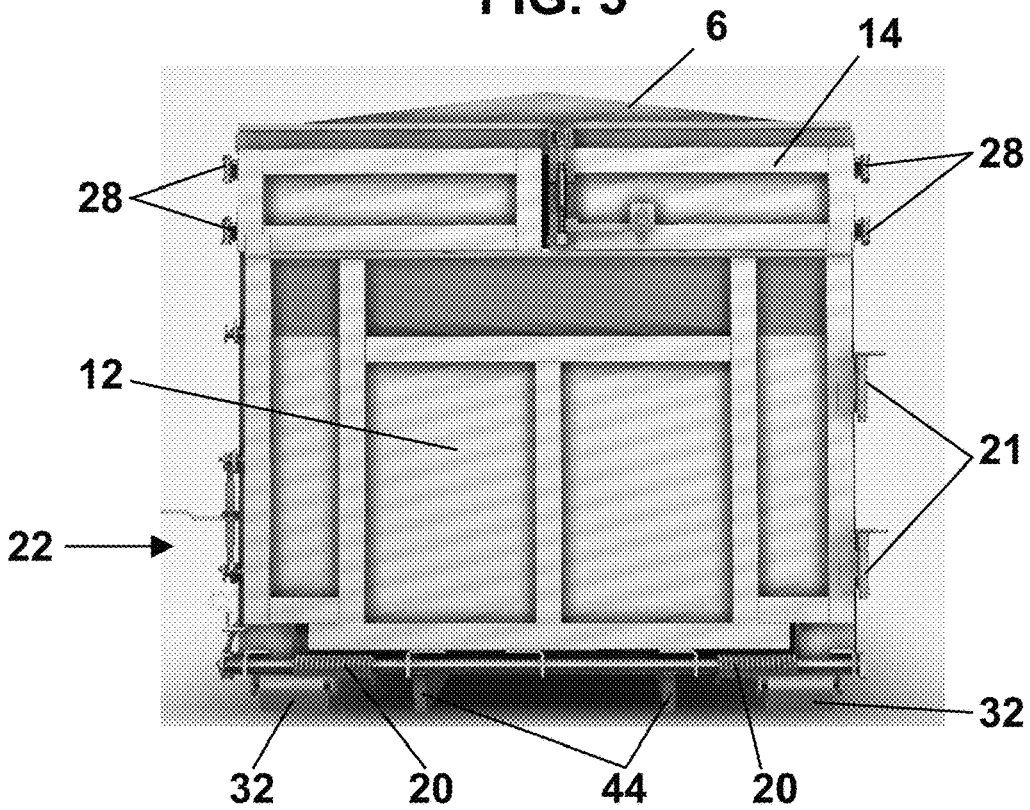
FIG. 5 is a front view of the container of FIG. 1.

The ramp wall is connected with the container at a lower end via a horizontal pivot assembly 16 and a latch arm 17. The pivot assembly includes a horizontal shaft 18 extending the width of the container from side wall to side wall and a pair of helical torsion springs 20 that are arranged around the shaft and which engage the lower outer end of the ramp wall and the forward edge of the bottom wall to provide a force which allows for an individual to manually pivot the ramp wall from a downward open position, as shown in FIG. 1, to an upward closed position, as shown in FIG. 3. The shaft extends through a securement device 23 containing an opening which is arranged at the interface between a side wall and the bottom wall, and the latch arm 17 secures the shaft 18 so that the ramp can pivot about the horizontal axis between open and closed positions. When in its closed position, the ramp wall can be further secured to the container via a locking assembly 22, which include latches 24 connected with a side wall 4 and shafts 26 connected with a side edge of the ramp wall 12.

The ramp wall can be further connected with the container via vertical hinge assemblies 21, which are arranged at a side of the ramp wall and a side edge of a container side wall (shown in FIGS. 1 and 3). When the ramp wall is in its upright, closed position, pins extend through openings in knuckles, securing the ramp wall to the container side wall. The latch 17 can then be pivoted to a release position, allowing the horizontal shaft to be free and the ramp wall to swing open about the vertical hinge assemblies 21.

The barn doors 14 include a pair of doors connected to respective side walls via hinge assemblies 28 which allow for the doors to pivot, or swing, about a vertical access between open and closed positions. There is a lock assembly 30 which secures the doors in their closed positions. The combination of the ramp wall which can pivot about horizontal and vertical axes and barn doors which can swing open, provide multiple forms of access to the inner chamber of the container, depending on the reason for accessing the inner chamber and size of an opening that is required.

Figure 2:
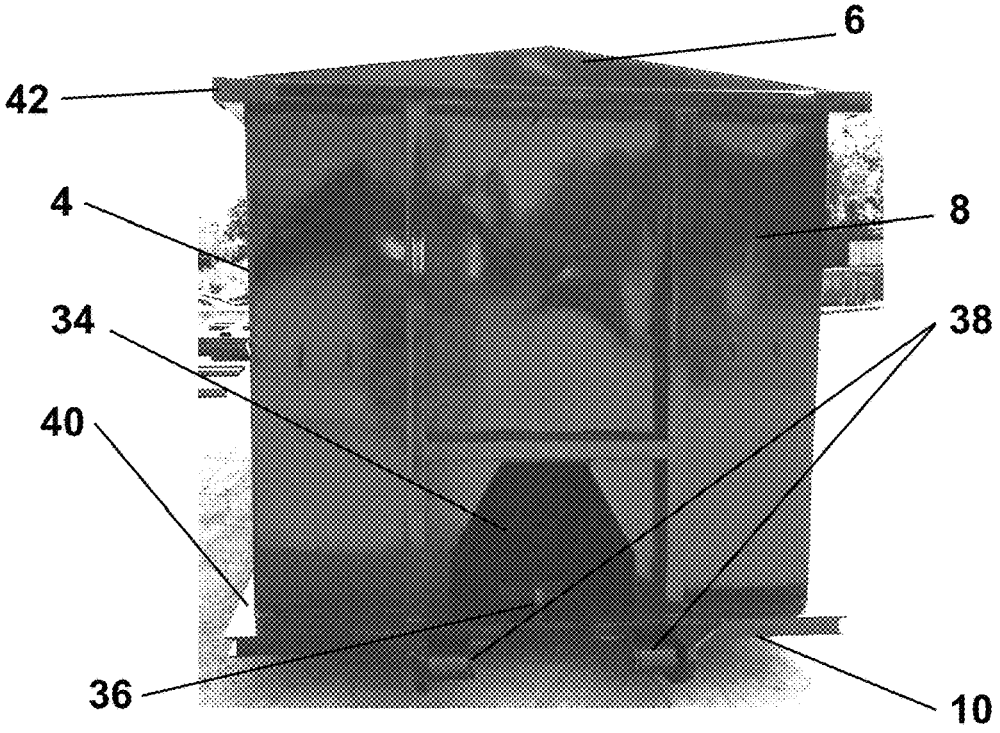
FIG. 2 is a rear view of the container of FIG. 1.

Referring to FIG. 2, the rear wall 8 includes a lower end opening 34 which provides access to a hook 36. When the container 2 is to be transported, a towing chain of a flatbed truck is connected with the hook and the container is pulled on to the truck. The container includes a pair of front and rear wheels 32. The front wheels allow the container to roll as it is lifted onto the truck.

In addition to the hook 36, the container 2 includes a pair of guide rails 44 which are connected with an outer surface of the bottom wall 10 and which extend along the length of the bottom wall terminating at ends 38 which extend beyond the bottom wall in proximity of the rear wall 8.

The bottom wall 10 and top wall 6 both include side wall edges 40 and 42, respectively, which extend beyond the side walls 4 and rear wall 8. Between the bottom wall and top edges are posts 41 (shown in FIGS. 1 and 4) which provide further support to the container 2.

Figure 6:
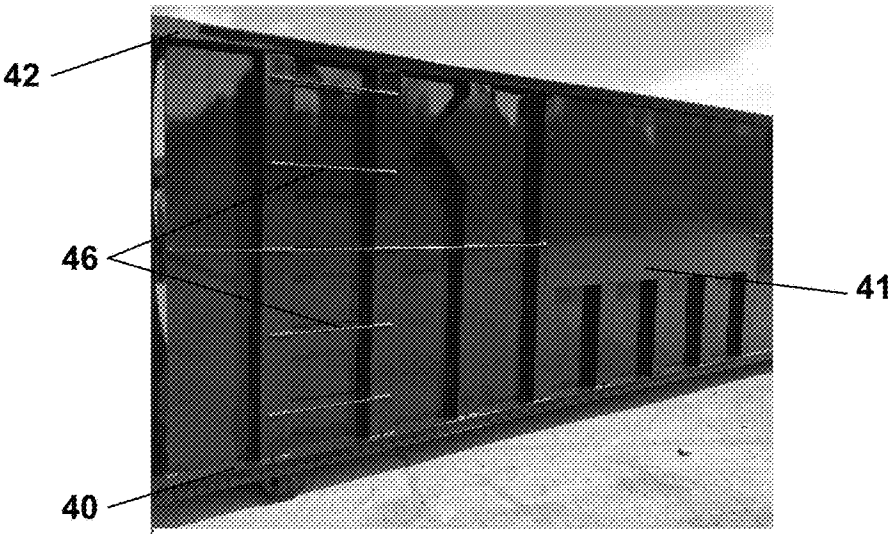
FIG. 6 is a side perspective view of the container of FIG. 1.
Figure 7:
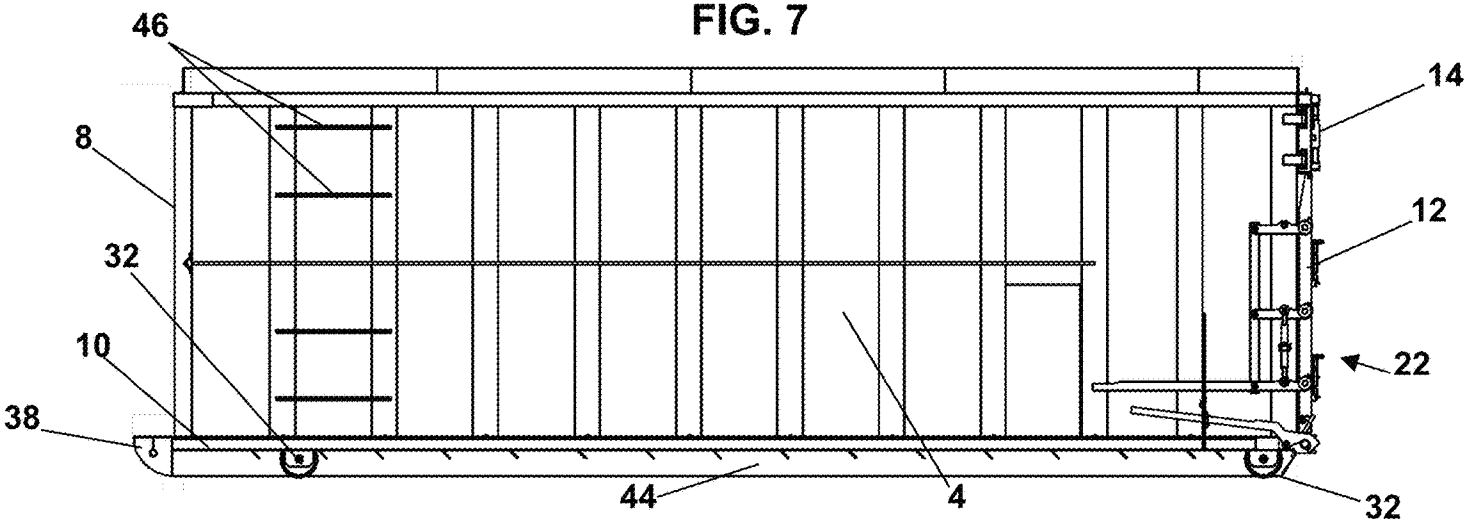
FIG. 7 is a side view of the container of FIG. 1.

As shown in FIGS. 6 and 7, a side wall 4 of the container 2 includes crossbars 46 which can be used a way of accessing an open upper end of the container when the top wall 6 is not connected.

Figure 8:
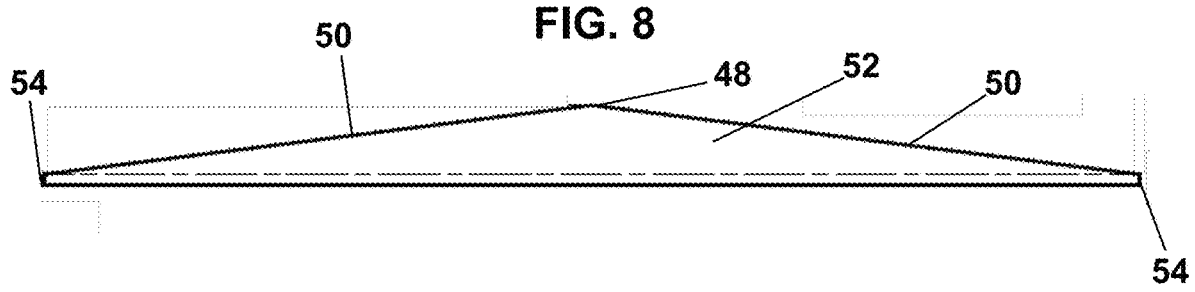
FIG. 8 is a front view of the top wall of FIG. 1.
Figure 9:
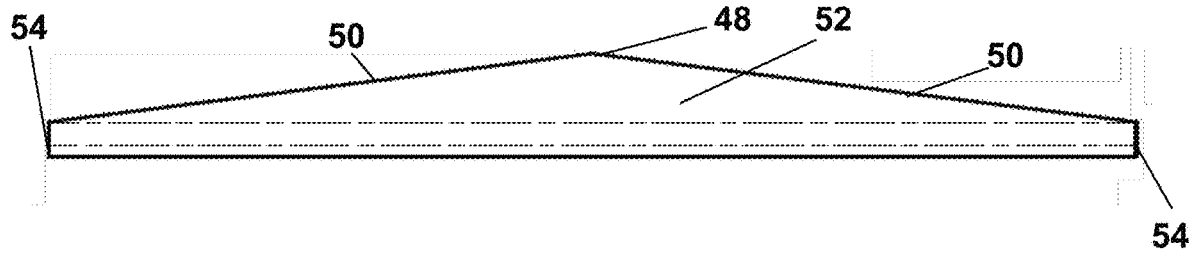
FIG. 9 is a rear view of the top wall of FIG. 1.
Figure 10:
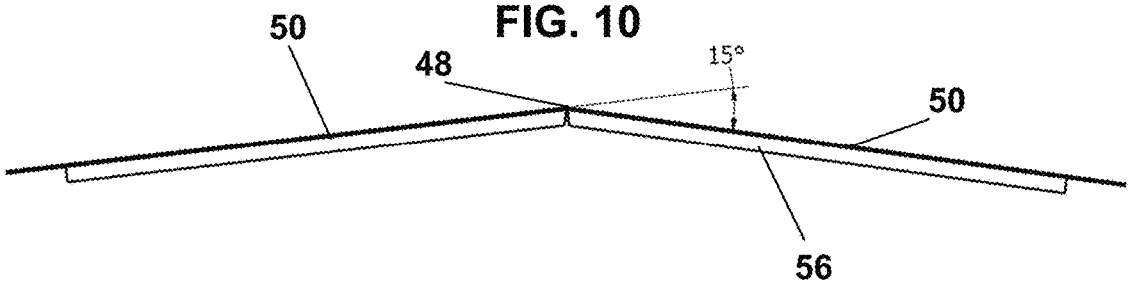
FIG. 10 is a section view of the top wall of FIG. 1.

Referring now to FIGS. 8-10, further details of the top wall 6, or roof, are shown. FIGS. 8 and 9 show front and rear views, respectively, of the pitched roof, which includes a peak 48 centrally located between two planes 50, front and rear walls 52, and side walls 54. As is shown, the width of the side wall is greater at the rear portion of the roof than at the front portion.

FIG. 10 shows a vertical cross-section of the peak 48 and planes 50 of the roof 6. This view shows rafters 56 which provide support to the roof. It will be understood that the number of rafters could vary between different embodiments. Moreover, an embodiment of the roof might not include rafters. As is shown in FIG. 10, the roof is pitched at a 15 degree angle. This could vary from one embodiment to another without deviating from the spirit of the invention. Preferably, the roof is made of a rigid material such as a metal.

The container 2 of this embodiment includes integral side 4, rear 8 and bottom 10 walls and a top wall 6 that connects flush with the upper edges of the rear wall, side walls and front barn doors 14. This ensures the inner chamber 15 of the container will be secured and free of effects from external elements.

Figure 11:
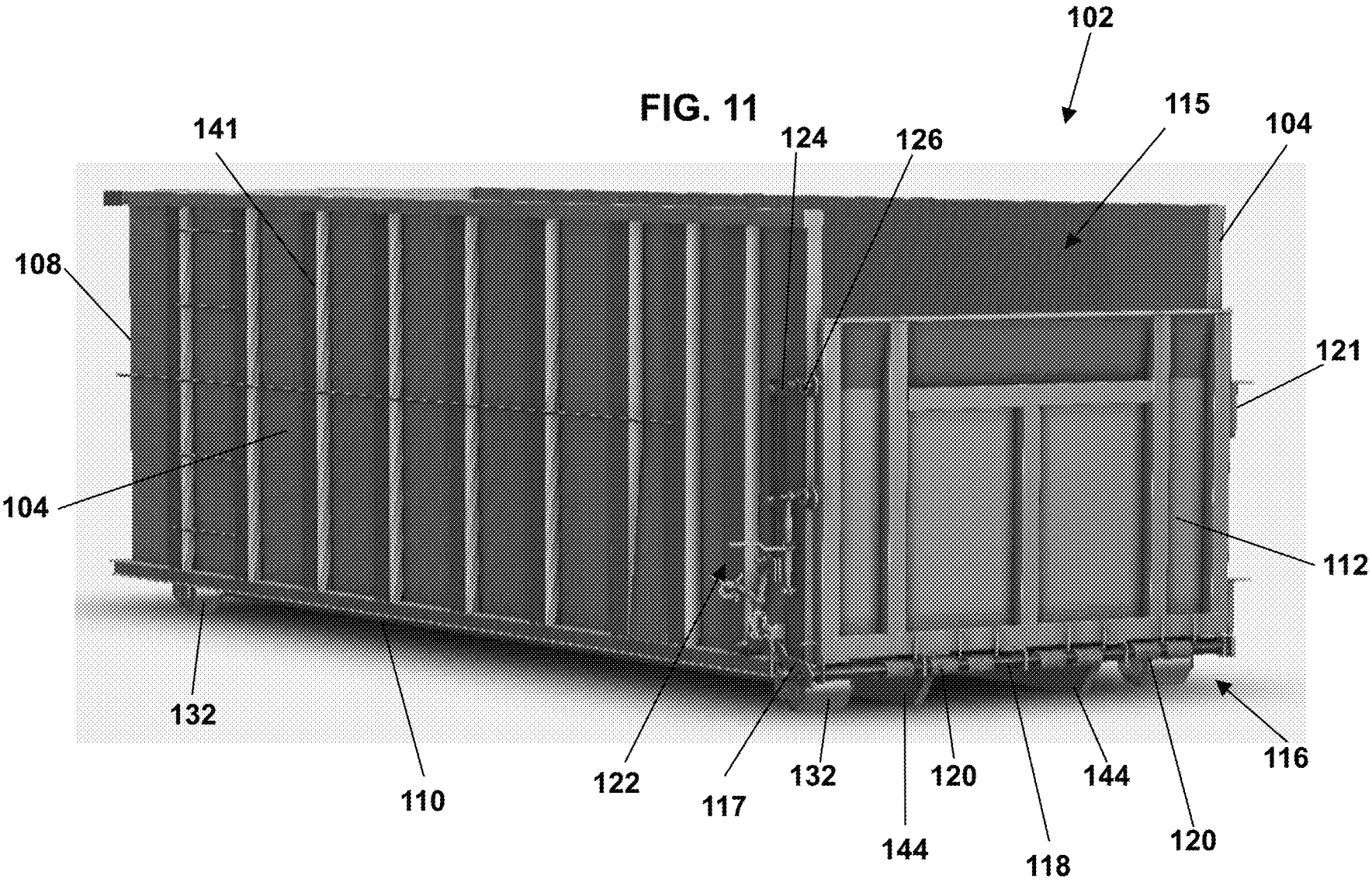
FIG. 11 is a perspective view of a second embodiment of a container having a ramp wall according to the present disclosure.
Figure 12:
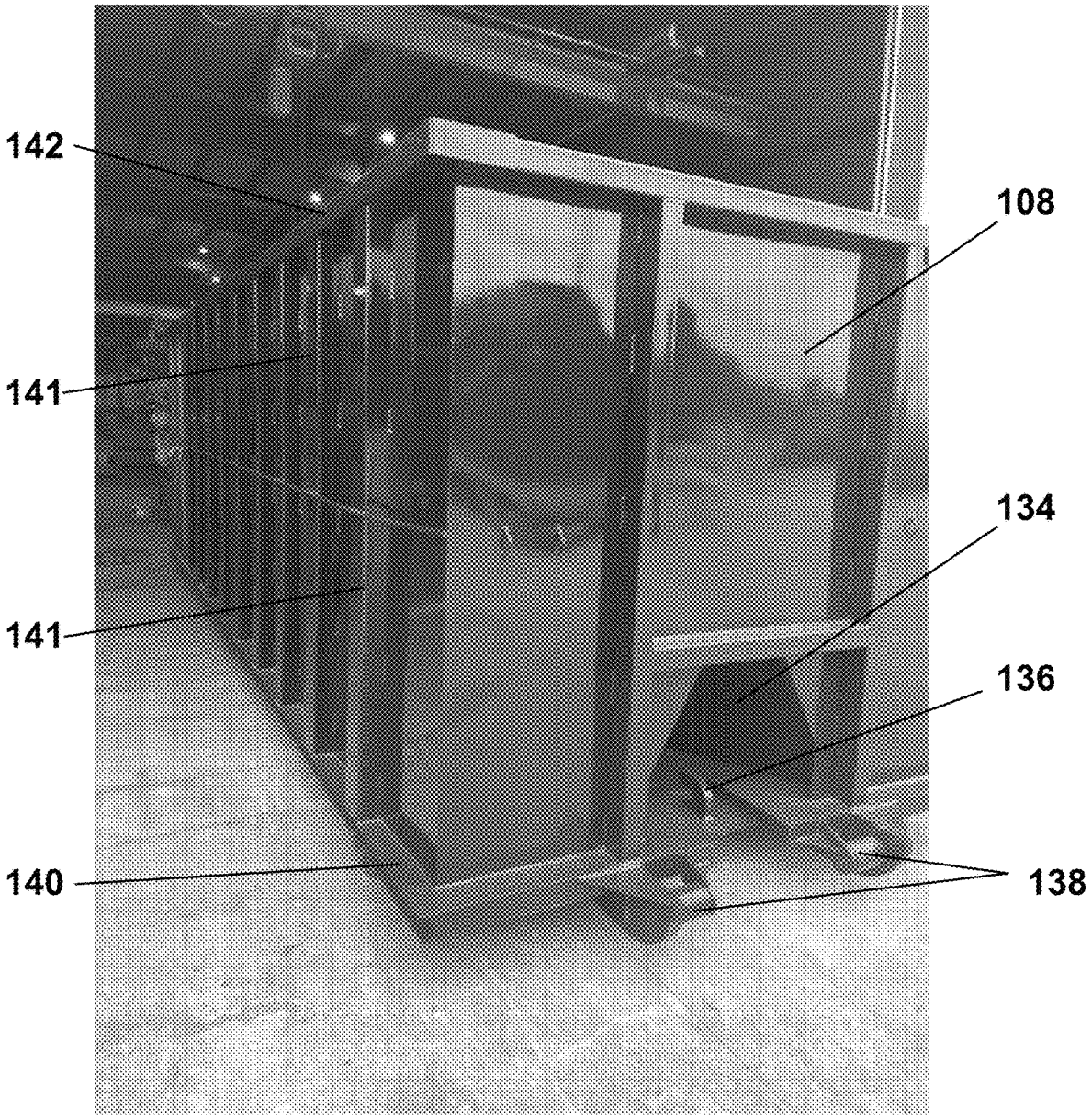
FIG. 12 is a rear perspective view of the container of FIG. 11.
Figure 13:
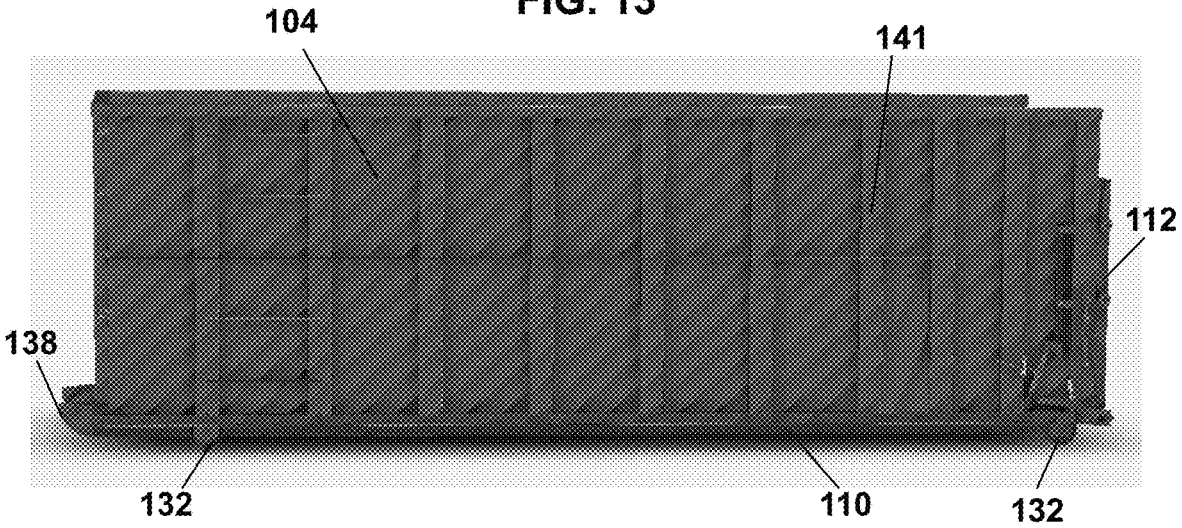
FIG. 13 is a side view of the container of FIG. 11.
Figure 14:
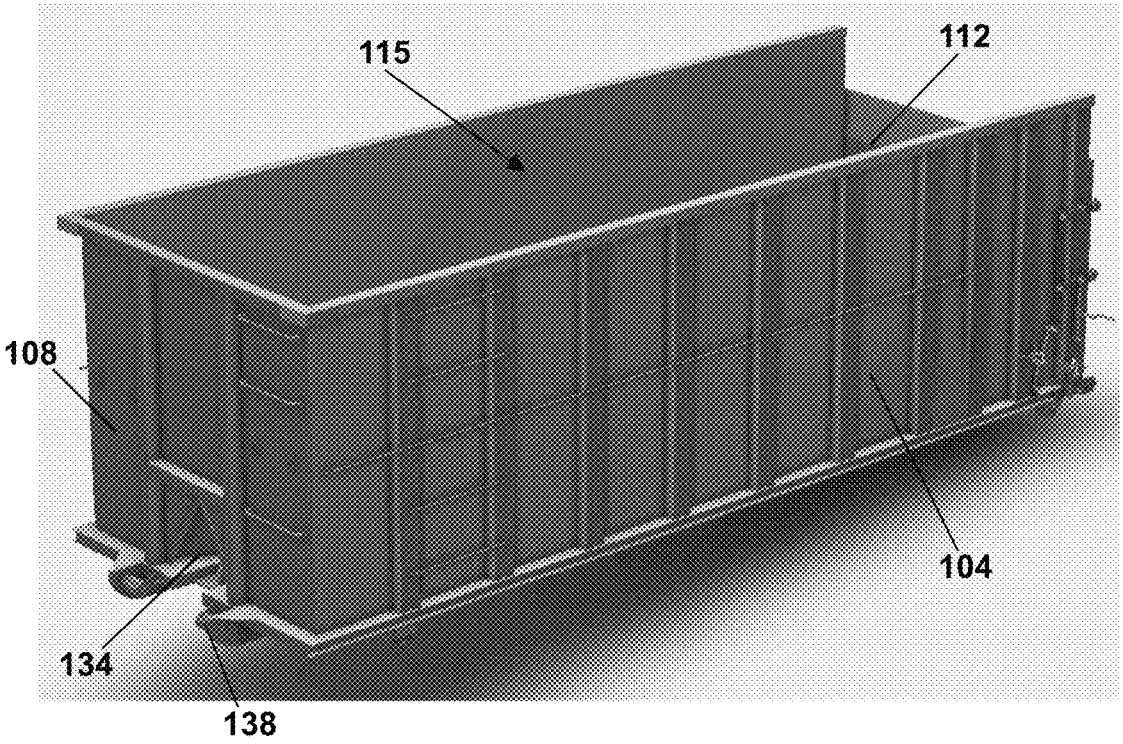
FIG. 14 is a top perspective view of the container of FIG. 11.

FIGS. 11-14 show a second embodiment of a container having a ramp wall. As with the embodiment of FIGS. 1-7, this embodiment includes a container 102 having side walls 104, a rear wall 108, a bottom wall 110 and a front ramp wall 112. This embodiment does not include a top wall or a pair of barn doors arranged above the ramp wall. As is shown in FIG. 11, the ramp wall extends approximately two-thirds the way up the front edges of the side walls 104 when in its closed position. This allows for access to the inner chamber 115 of the container without the need for lowering the ramp wall, or swinging open the ramp wall or barn doors. In addition, this allows for a lower access point to the inner chamber, as opposed to an open upper end.

As with the embodiment of FIGS. 1-7, the ramp wall includes a horizontal pivot assembly 116 with a pivot shaft 118 and helical torsion springs 120, as well as a vertical pivot assembly which includes hinges 121. When the ramp wall is in its upright, closed position, the latch 117 secures and releases the pivot shaft depending on whether the ramp wall will be pivoted down or swung across to its relative open positions.

The remainder of this container 102 is similar to that of the container 2 of FIGS. 1-7 with like numbers referring to like elements, including a locking assembly 122 with latches 124 and shafts 126, wheels 132, a rear end opening 134 with hook 136, guide rails 144 with ends 138 extending beyond the end of the container, and side edges 140 and 142 with posts 141 extending therebetween.

Figure 15:
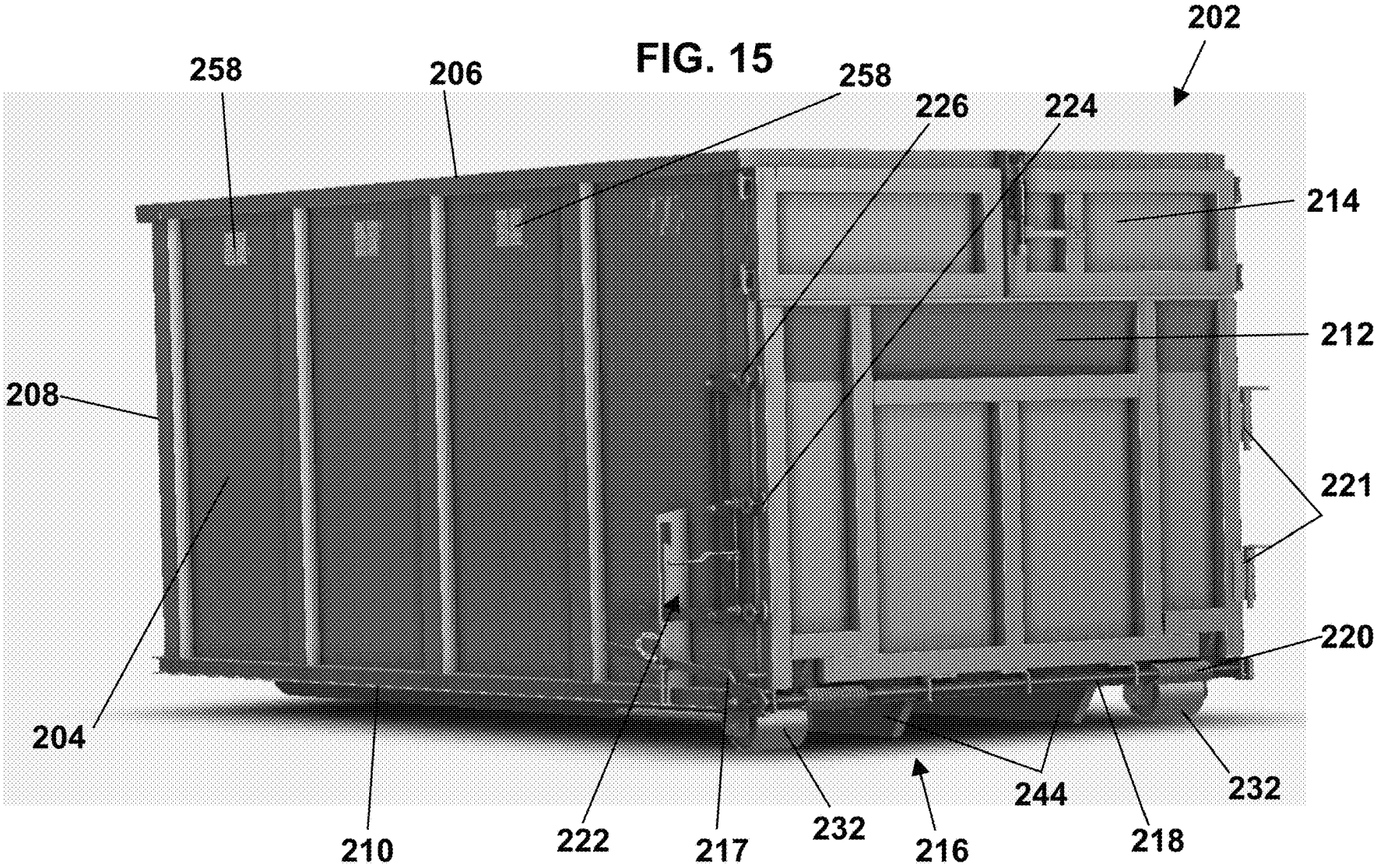
FIG. 15 is a perspective view of a third embodiment of a container having a ramp wall according to the present disclosure.
Figure 16:
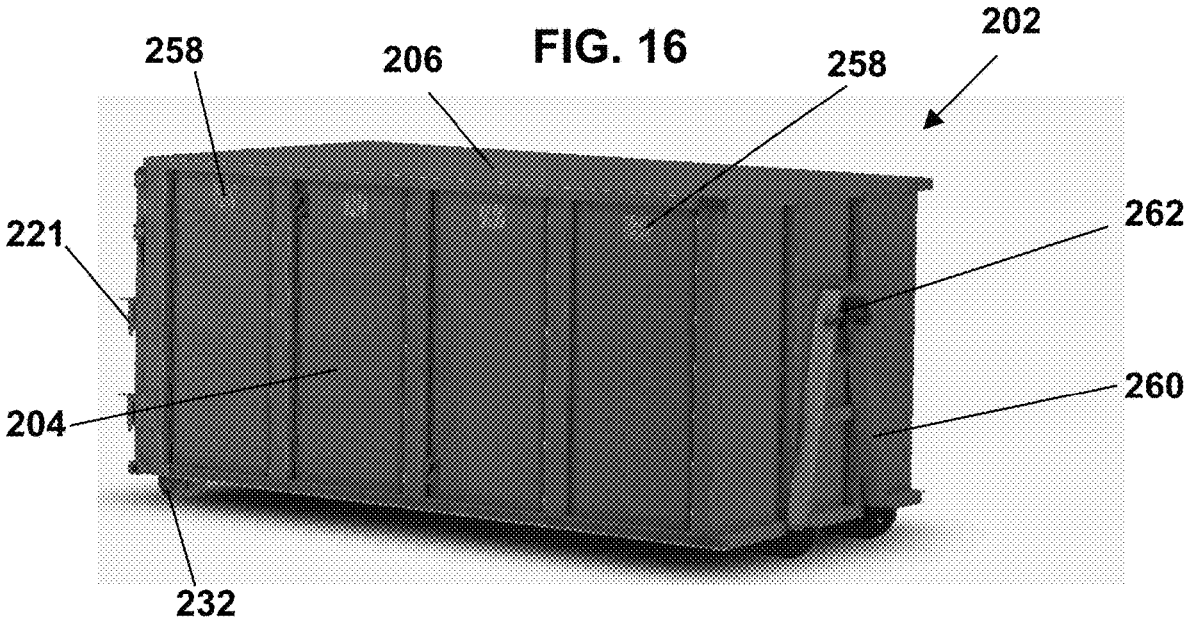
FIG. 16 is a rear perspective view of the container of FIG. 15.
Figure 17:
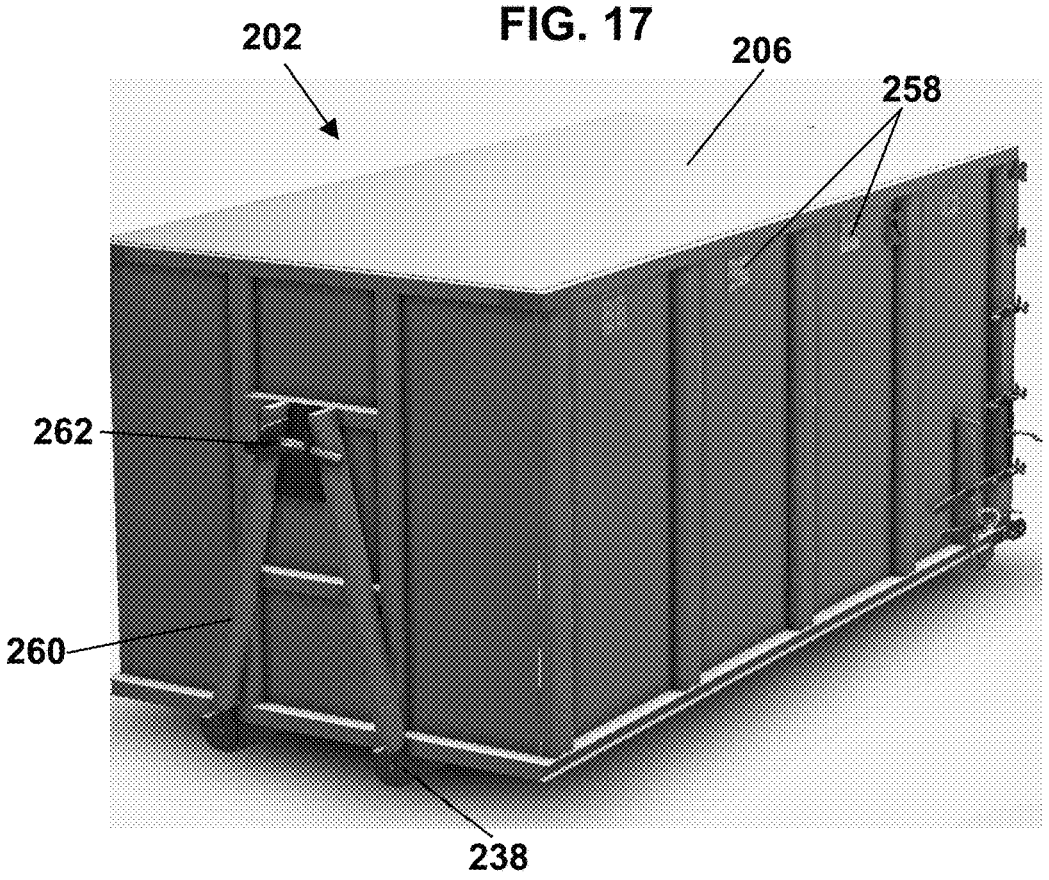
FIG. 17 is a top perspective view of the container of FIG. 15.

Referring now to FIGS. 15-17, a third embodiment of a container with a ramp wall is shown. The container 202 includes a container body having side walls 204, a top wall 206, a rear wall 208, a bottom wall 210, a ramp wall 212, and a pair of barn doors 214. The ramp wall of this container also includes a horizontal pivot assembly 216 having a pivot shaft 218 and helical torsion springs 220, as well as a vertical pivot assembly 221. As with the embodiment in FIGS. 1-7, the ramp wall is pivotable about a horizontal axis to a downward open position and an upward closed position and can also be swung open via the vertical pivot assembly. A latch 217 secures or releases the pivot shaft 218 and locking assemblies 222 with latches 224 and shafts 226 secure the ramp wall when it is in its closed position.

The embodiment of FIGS. 15-16 further includes vents 258 arranged along upper ends of the side walls 204 and a flat top wall 206. When the barn doors and ramp wall are closed and locked, the entire container is sealed. However, there may be instances when materials within the container require ventilation, thus the vents 258 provide for this. The flat roof results in a container having a cuboidal shape, which provides benefits for transporting and/or storage of the container.

The container of this embodiment also includes wheels 232, but only two wheels located proximate to the front ramp wall. A pair of guide rails 244 also extend along an outer surface of the bottom wall 210 to ends 238 that extend beyond the container. The rear of the container, however, does not include an opening with a hook, but rather includes a pair of pivotable arms 260 extending at an angle from the guide rail ends 238 to a securement device 262 arranged centrally on the rear wall 208. The pivotable arms are engaged by a lifting device from a truck to lift the container onto the truck.

Although the above description includes reference to particular embodiments, it is to be understood that these embodiments are merely illustrative of the principles and applications of the present disclosure. It is therefore to be understood that numerous modifications may be made to the illustrative embodiments and that other arrangements may be devised and employed without departing from the spirit and scope of the present disclosure.

What is claimed is:

1. A roll-off container for storing and transporting materials, comprising:

a) a container body having a generally rectangular configuration including a bottom wall, a pair of side walls connected with the bottom wall, a front end and a rear end defining an inner chamber, the front end having a height defined by forward edges of the bottom wall and upper edges of the side walls and a width defined by a distance between forward edges of the side walls, the front end including:

i. a rectangular ramp wall pivotably connected with the container body adjacent the front end for pivotable displacement of the ramp wall about one of a horizontal and vertical axis to provide pivotal movement of the ramp wall between closed and open positions, the ramp wall having top, bottom and side edges defining a height and width of the ramp wall, the height being less than the height of the container front end and the width being equal to the width of the container front end, wherein when the ramp wall is in its closed position, the ramp wall side edges contact the forward edges of the container side walls;

ii. a front end barn door being pivotably connected with opposing respective front edges of the container body side walls about vertical axes between closed and open positions to provide access to the inner chamber, the at least one front end door having a height that is substantially less than the height of the container front end and a width that is equal to the width of the container front end, wherein when the at least one front end door is in its closed position, side edges of the at least one front end door contact the forward edges of the side walls, the height of the ramp wall and the height of the at least one front end door combining to equal the height of the front end, a lower edge of the at least one front end door being arranged above an upper edge of the ramp wall when the at least one front end door and the ramp wall are in their closed positions such that the front end barndoor and ramp wall are pivotable to their respective open positions independent of the other; and iii. a rigid pitched roof connected with the rear and side walls, a peak of the roof extending longitudinally along the roof;

b) a tow hook arranged at a rear end of the container body; and c) a pair of wheels connected with the bottom wall at each end of the container.

2. The container of claim 1, wherein the height of the ramp wall when it is in its closed position is greater than half the height of at least one of the container side walls.

3. The container of claim 1, wherein the container further includes at least one pivot shaft and at least one helical torsion spring to provide pivotal movement of the ramp wall relative to the container body, the at least one pivot shaft being arranged at a lower end of the container front end and connected with a lower end of the ramp wall, the at least one helical torsion spring being arranged around the at least one pivot shaft.

4. The container of claim 1, wherein the ramp wall is removably connected with the container body for pivotable displacement about a horizontal axis and is removably connected with the container body for pivotable displacement about a vertical axis.

5. The container of claim 1, wherein the rigid pitched roof includes at least one rafter attached with an inside surface of the roof and extending from the peak to a side edge of the roof.

6. The container of claim 5, wherein the rigid pitched roof is pitched at a 15-degree angle.

7. The container of claim 1, wherein the rear wall includes an opening in which the tow hook is arranged.

* * * * *